US007331397B1

(12) United States Patent
Wagley et al.

(10) Patent No.: US 7,331,397 B1
(45) Date of Patent: Feb. 19, 2008

(54) GAS DRIVE FLUID LIFTING SYSTEM

(75) Inventors: Allen Wagley, Houston, TX (US); Donald H. Grubbs, Ventura, CA (US)

(73) Assignee: Jet Lifting Systems, Ltd, Odessa, TX (US)

( * ) Notice: Subject to any disclaimer, the term of this patent is extended or adjusted under 35 U.S.C. 154(b) by 230 days.

(21) Appl. No.: 10/986,694

(22) Filed: Nov. 12, 2004

(51) Int. Cl.
*E21B 43/00* (2006.01)

(52) U.S. Cl. ..... 166/372; 166/328; 417/151

(58) Field of Classification Search ..... 166/372, 166/370, 325, 328, 332.8; 417/151, 160, 417/172

See application file for complete search history.

(56) References Cited

U.S. PATENT DOCUMENTS 1,354,027 A 9/1920 Crowell
2,021,997 A * 11/1935 Hewgley ..... 417/108
2,983,229 A 5/1961 Went
3,215,087 A * 11/1965 McLeod, Jr. ..... 417/55
3,884,299 A * 5/1975 McCarter et al. ..... 166/68
4,135,364 A 1/1979 Busick
4,390,061 A 6/1983 Short
4,527,956 A 7/1985 Baumberg
4,605,069 A * 8/1986 McClaflin et al. ..... 166/310
4,666,377 A 5/1987 Brown
4,988,389 A * 1/1991 Adamache et al. ..... 166/302
5,006,046 A 4/1991 Buckman
5,374,163 A * 12/1994 Jaikaran ..... 417/172
5,671,813 A 9/1997 Lima
5,730,220 A 3/1998 Ganelin
5,806,598 A 9/1998 Amani
5,873,410 A 2/1999 Lato
5,950,651 A 9/1999 Kenworthy
6,021,849 A 2/2000 Averhoff
6,170,573 B1 1/2001 Brunet
RE37,109 E 3/2001 Ganelin
6,237,692 B1 5/2001 Averhoff
6,269,884 B1 8/2001 Averhoff
6,298,918 B1 10/2001 Franco
6,354,371 B1 * 3/2002 O'Blanc ..... 166/69
6,354,377 B1 3/2002 Averhoff
6,629,566 B2 * 10/2003 Liknes ..... 166/372
6,688,385 B1 2/2004 Moe
2002/0182089 A1 12/2002 Mavel

* cited by examiner

*Primary Examiner*—Jennifer H. Gay
*Assistant Examiner*—Daniel P Stephenson
(74) *Attorney, Agent, or Firm*—Parks & Assoc.

(57) ABSTRACT

A passive collection and pneumatic lifting system located in a well comprising a pneumatic tube, a fluid tube mounted within the pneumatic tube creating an annulus and a jet barrel chamber formed between the pneumatic tube and fluid tube in fluid communication at the zone to be recovered. A valve in the jet barrel in communication with the jet barrel and the zone to be recovered for allowing passive flow of product to be recovered into the jet barrel for collection therein and for closing upon the introduction of pneumatic fluid pressure by a pneumatic pressure generator to generate pneumatic fluid pressure sufficient to drive the product collected in the jet barrel up hole for recovery. A seal is located below the valve for sealing the product zone in the well from flow except through the valve.

8 Claims, 4 Drawing Sheets

Fig. 5
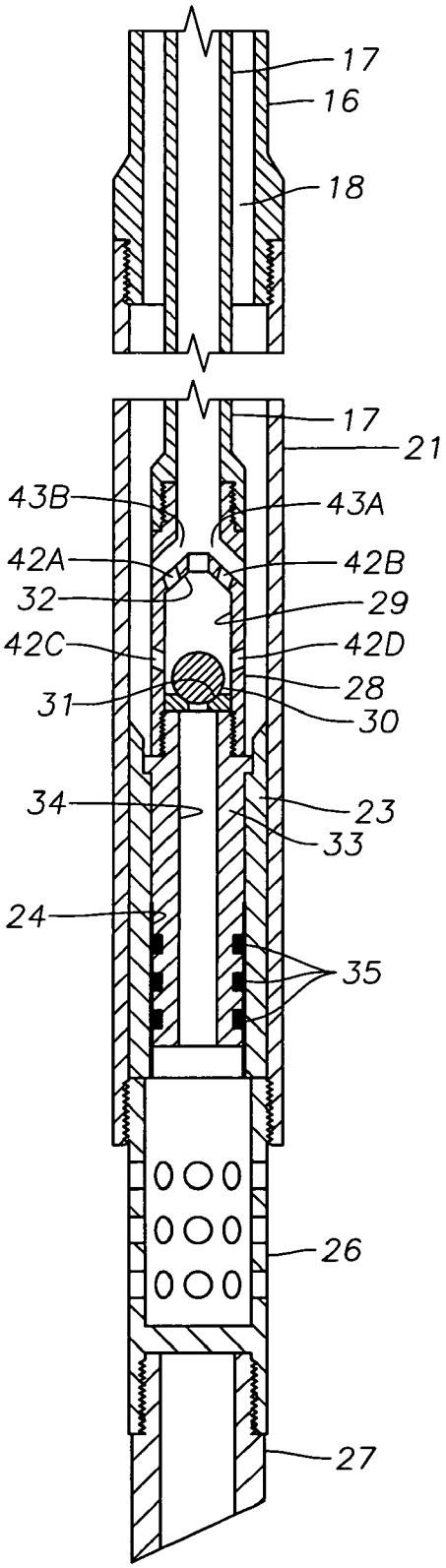
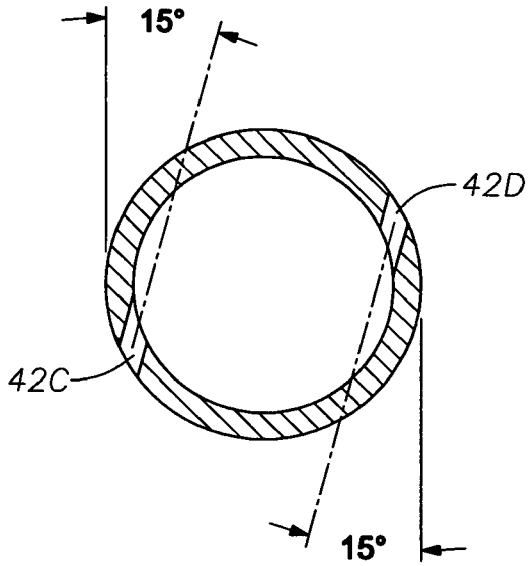
Fig. 6
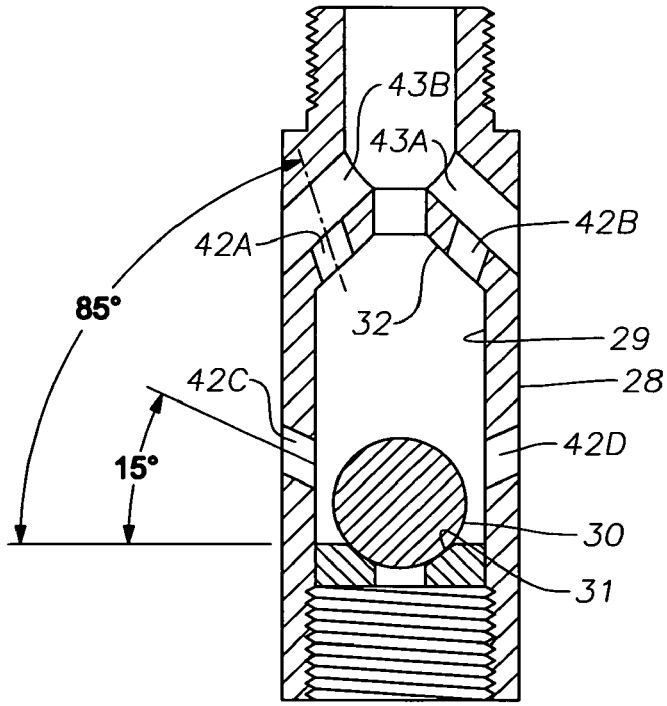
Fig. 7

GAS DRIVE FLUID LIFTING SYSTEM

SUMMARY OF INVENTION

This invention relates generally to a passive pneumatic lifting system for wells and is partially positioned in the well bore at the product zone to be recovered and partially positioned substantially up hole from the zone to be recovered. The system of this invention has at least one pneumatic pipe and at least one fluid pipe which while independent of each other function together to make this system operational. The one fluid pipe, for an example, is mounted inside the one pneumatic pipe, for an example, for creating an annulus between the outside diameter of the liquid pipe and the inside diameter of the pneumatic pipe for allowing pneumatic fluid communication therein. A pneumatic pressure generator is connected to the one pneumatic pipe for generating a pneumatic fluid pressure into the annulus created between the one pneumatic pipe and the one liquid pipe. A jet barrel is created from the one pneumatic pipe having an inside diameter greater than the one fluid pipe and an outside diameter less than the well bore or well casing at the zone to be recovered. The jet barrel created is positioned substantially in the product zone to be recovered and is in fluid communication between the one pneumatic pipe and the one fluid pipe. A valve is connected to the one fluid pipe and it comes to being located in the bottom of the jet barrel as the one fluid pipe is lowered to it final position inside the one pneumatic pipe in the well bore. The valve is also in fluid communication with the jet barrel and the product zone to be recovered and has a stab-in with at least one seal thereon. The final positioning of the valve on the one fluid pipe in the jet barrel is such that it is located at the bottom of the jet barrel formed. The stab-in with the at least one seal thereon is inserted into the seal with a Stab-in receiver connected to the one pneumatic pipe portion which forms the jet barrel. Once in place a removable seal is formed below the valve for sealing the production zone to be recovered from flow except through the valve. This insertion of the stab-in into the stab-in receiver occurs so proximate to the valve it stabilizes against hammering effects upon the valve's actuation. The connection between the stab-in with seals and the stab-receiver is a removable seal which can either be formed or removed and reformed again by pulling the at least one fluid pipe up hole or re-lowering it down hole. In other aspects this invention includes a one way valve which has a chambered ball and valve seats and ports set at various angles for creating different types of vortex in the chamber of the ball and the valve seats for agitating and cleaning the ball and seats of well debris during each cycle of the pneumatic fluid pressure being generated in the lifting system. This lifting system can be manually operated or provided with automatic controls and/or sensors set for various criteria, such as time intervals, fluid levels, etc by way of example only, for when a cycle is ready for operation to lift the product to be recovered. Further this lifting system because of its manner of creation in forming a removable seal in the well as the lifting system is created, it is also for easy repair without having to pull the whole system out of the well.

BACKGROUND OF THE INVENTION

This invention is directed to a fluid lifting system and while it specially relates to oil recovery has it application to any fluid lifting application where passive and/or intermittent fluid recovery may be desired. In its oil field applications it is directed to wells generally defined as "stripper wells". "Stripper wells" are wells that are not self producing because the zones of production have ceased to have sufficient pressure to drive the oil and or gas/oil mixture to surface in sufficient quantities to be commercial.

Some "Stripper Wells" are produced by pump jacks which have a lifting plunger piston for lifting the oil to the surface in incremental steps with each cycle of the lifting plunger. A pump jack has many moving parts and is designed for continuous operation for periods of time, but not one or two cycles at intermittent periods. Further they are expensive and require maintenance because of their many moving parts. The lifting plunger is a part especially subject to ware because of its constant up and down motion. When time comes to replace lifting plunger, it is expensive and the well must be shut down for the operation.

The operational costs as well as the maintenance costs for repairs on a "Stripper Well" can kill the commercial value of such a well because they are of marginal economic value and any increase in maintenance costs can kill the value of a "Stripper Well" from further recovery while valuable oil may still remain in the well.

These "Stripper Wells" over the years have become increasingly more important even as their production continues to decline because the value of oil has continued to rise. In that regard the prior art has developed numerous ways to produce such wells.

One such prior art approach has been to use a pair of u-shaped tubing with one of the pair dedicated to liquid discharge portion and the other to high pressure gas for driving the liquid portion to the surface. This prior art relies on the high pressure gas being held back while the liquid accumulates in the liquid discharged portion of the pipe and then a valve being opened to drive the liquid up hole for recovery. While this prior art was a step forward, it still provided more tubing surfaces to the well bore which is a very corrosive environment and as those skilled in the are will appreciate the less metal down hole the better. It further provided the need for a mechanism to hold the high pressure gas back while the fluid pipe was being filled at lower pressures. Any leak in the valve holding the pressured gas would cause the recovery system to fail and could cause damage to the well formation at the production zone.

Another prior art approach which attempted to eliminate the tubing exposure and increase the recovery used a first and second columns with the first column being located with in the second column having a larger diameter at the lower portion to form a storage chamber for the fluid to be recovered. In this prior art a one-way value was provided to the storage chamber and a one way valve was provided to said second column and then an gas injector for injection of gas into the annular space between the first and second tubing to drive the liquid to the surface. As this prior art was an integrated or unitized system it required that the whole system be installed as one piece (parallel installation) or pulled for repairs as one piece which added to the cost of installation and to the maintenance costs of a well. These additional costs, which has have been explained, could kill the value of the well from further recovery.

The prior art has recognized that as the increase in value of oil and its availability decreases it has become more desirable to become more efficient and find reliable means for its recovery. Some of that prior art has developed simpler and yet more reliable methods such as using a simple ball type standing valve which is opened by the rush of lifting gas and liquid for recovery and then checking the back flow back into the well until the next lifting cycle occurs. The problems with this approach is that there is no cleaning of the valve at each cycle and the valve can become stuck and corroded shut with the need for maintenance and these prior art system required the whole system to be pulled for repair as they were unitized. Also in the prior art the relative position of the valve in relation to its position to the gas injection port could set up air hammering which could cause metal fatigue and early failure of the whole system.

Other lifting systems attempted to solve the maintenance and repair aspects of system used in "Stripper wells" by using moving pistons which allowed oil to collect on top of a piston which was positioned in a well bore in a liquid pipe and then have pressurized gas injected into the liquid pipe below the piston to drive the slug of oil and piston out of the well for recovery. This system solved the problem of having to pull the whole system for repairs as the piston was intermittently at the top of the well and was readily accessible for repairs. Also these type system had the ability to perform additional monitoring functions of a well which provided additional cost reductions for the over all operation of a "Stripper well". These piston driven systems however had some draw backs as the pressure behind these piston must be accurately controlled less they become rockets of destruction on their arrival at the ground level. To control these problems expensive force adsorbing devices were provided to handle slight excesses of force in landing these moving pistons at the top. However these systems added to the over complexity of system and added additional costs which as discussed are the "Death knell" to the "Stripper well".

Finally the prior art whether of data gathering or plunger or pneumatic type systems were relatively expensive in equipment and man power costs and required multiple trips into the a well to install and recover for repair. In cases were multiple trips were required it required the balancing of tension in two independent pipes going into the well bore less one collapse upon the weight of the other and thus these systems were also difficult and expensive to install.

OBJECTS OF THE INVENTION

It is the object of this invention to provide a passive pneumatic lifting system for wells having as few moving parts as possible and the parts that are provided are very simple and subject to long ware with little or no operation expense.

Yet a further object of this invention is to provide a self cleaning mechanism which is incorporated in the pneumatic lifting of the product to be recovered such that as the product is being lifted cleaning of the very simple parts of the system occurs to keep them clear for long periods of time between well maintenance.

Also an object of this invention is to provide a passive pneumatic lifting system for wells which is easy to install and may be installed one piece at a time, serially installed, rather than all the pieces at once, parallel installed, which thus eliminates the complication of having to hold multiple pieces in tension while installing the system and securing them to the well head structure. This also allows the use of less expensive rigs for the installation of the system of this invention which is a cost saving factor.

Still further an object of this invention is to provide a passive pneumatic lifting system for wells have only one valve at the down hole dirty end of the system and that one valve is as freely moving as possible to prevent jamming or sticking during operation.

It is an object of this invention to provide a passive pneumatic lifting system for wells which has ports set at a range of angles to the ball and seat of the valve and tangent to the walls of the ball valve chamber either in combination or individually to create a cleaning vortex in the ball valve chamber for washing the valve on each lifting cycle.

Further an object of this invention is to provide a passive pneumatic lifting system for wells which may be easily cleaned by removing only the one liquid pipe member and breaking a removable seal to bring the valve and stab-in portion up to the surface for easy repair of the valve and then reinserting it back into the well to reform the removable seal and start the operation of the passive pneumatic lifting system again. This allow for using smaller and less expensive work over rigs and thus easy and inexpensive repairs to put the system back in operation.

Also an object of this invention is to provide a passive pneumatic lifting system for wells which only supplies the quantity of pneumatic fluid pressure, compressed gas, to the system as and when it is needed and does not depend on a constant gas pressure be maintained in the system to be delivered through a valve to drive the product of recovery to the surface.

Yet a further object of this invention is to provide a passive pneumatic lifting system for wells which can used with different sensors for determining when the criteria has been reached to generate the pneumatic fluid pressure to recover the product of recovery. This allows for example timers which determine intervals of when to generate a pneumatic fluid pressure and how long the pneumatic fluid pressure generated should last or sonic fluid measurement to be used to determine when to generate a pneumatic fluid pressure. Thus this invention has the ability to be used by those skilled in the art based on the operational characteristics of the well to be produced.

Further it is an object of this invention to provide a passive pneumatic lifting system for wells with the least amount of pipe and metal in the well bore and to make that which is provided to be as well "friendly" as possible and universal in the nature of its application.

Still other advantages and benefits of the invention will become apparent to those skilled in the art upon a reading and understanding of the following detailed description.

BRIEF DESCRIPTIONS OF THE DRAWINGS

This invention may be practiced in certain physical forms and arrangements of the parts herein described, but a preferred embodiment of which will be described in detail in the specification and illustrated in the accompanying drawings which form a part hereof.

FIG. 1 is a diagrammatic, fragmentary and partially cutaway view of one embodiment of this passive collection and pneumatic lifting system located in a well and partially positioned in the well bore at the production zone to be recovered and partially positioned substantially up hole from the zone to be recovered and showing the invention mounted in a well using standard well head assembly for an oil well.

Figure 2:
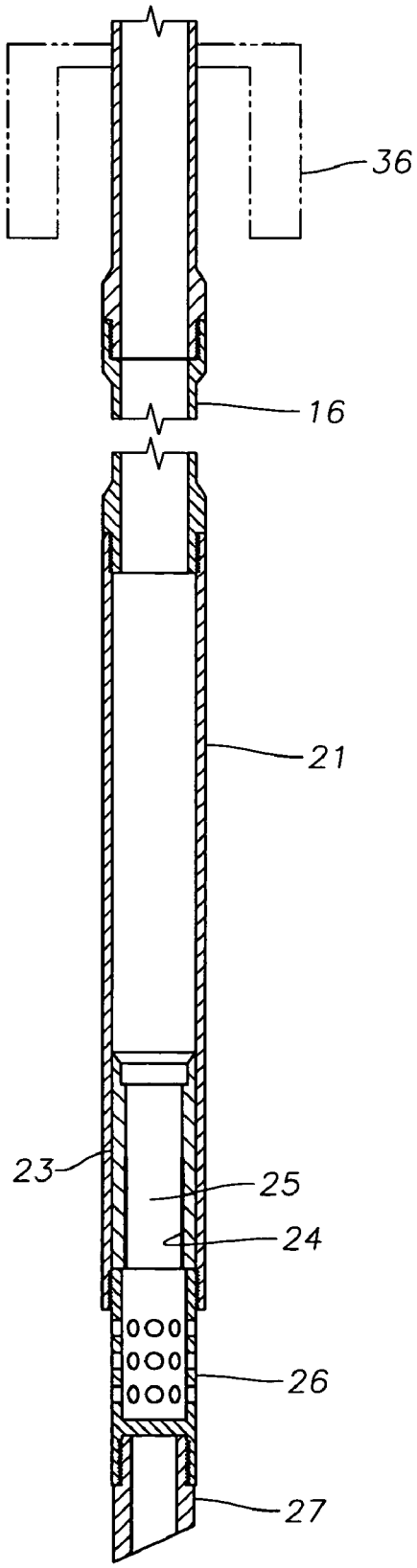
FIG. 2 is a diagrammatic and partially cutaway view of one embodiment of this invention with the at least one pneumatic pipe made up showing the exterior portion of the jet barrel, a stab-in receiver, a production screen and a mud anchor for being run into the well bore.
Figure 3:
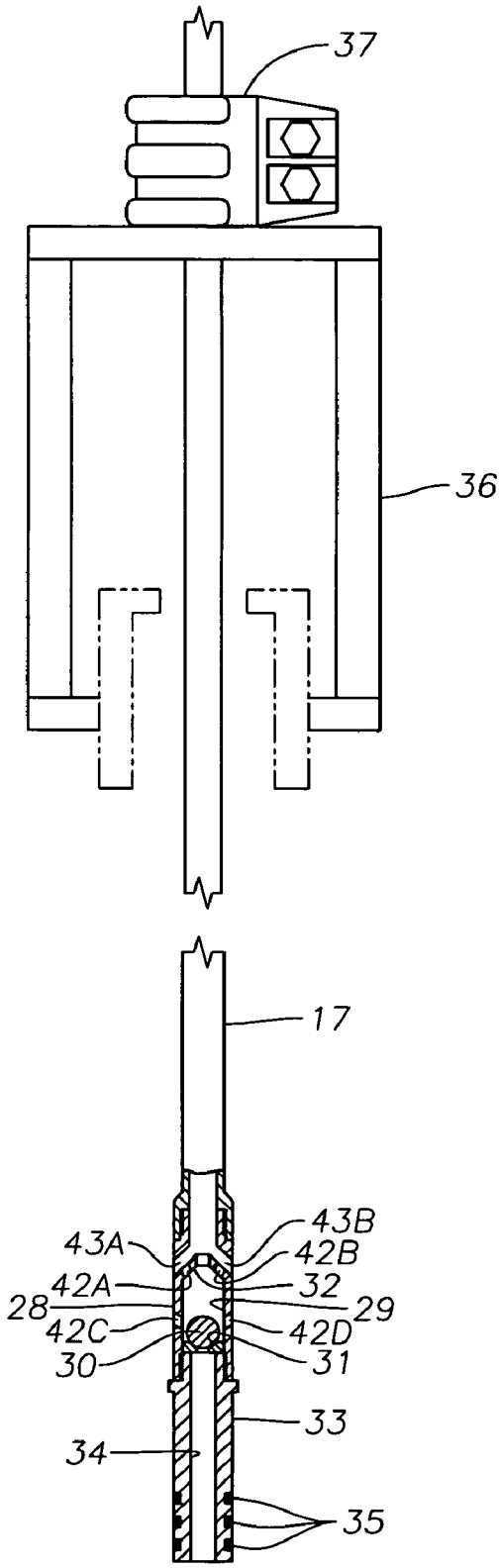
FIG. 3 is a diagrammatic and partially cutaway view of one embodiment of this invention showing the at least one fluid pipe member made up with the stab-in and seals and a one way valve member for being run into the at least one pneumatic pipe member after the at least one pneumatic pipe member has been run into the well bore.

FIG. 5 is a diagrammatic and partially cutaway view of one embodiment of this invention showing the at least one pneumatic pipe member of FIG. 2 and the at least one fluid pipe member of FIG. 3 fully inserted in place with the stab-in and seals and stab-in receiver fully engaged to form a removable seal there between and the jet barrel fully formed between the pneumatic pipe and the fluid pipe with the one way valve located substantially at the bottom of the jet barrel and open to communication by ports in fluid communication with the at least one pneumatic pipe member and flow from the production zone.

FIG. 6 is a cross section view of one embodiment of this invention taken through the valve chamber on FIG. 5 showing the ports at angles relative to the tangent of the chamber's body for inducing vortex in the valve chamber for cleaning the ball and the seats in the valve chamber.

FIG. 7 is a cross section view of one embodiment of this invention taken through the valve chamber on FIG. 5 showing the ports at angles relative to the seats and ball valve interface for inducing vortex in the valve chamber for cleaning the ball and the seats in the valve chamber.

DESCRIPTION OF THE PREFERRED EMBODIMENTS

Figure 1:
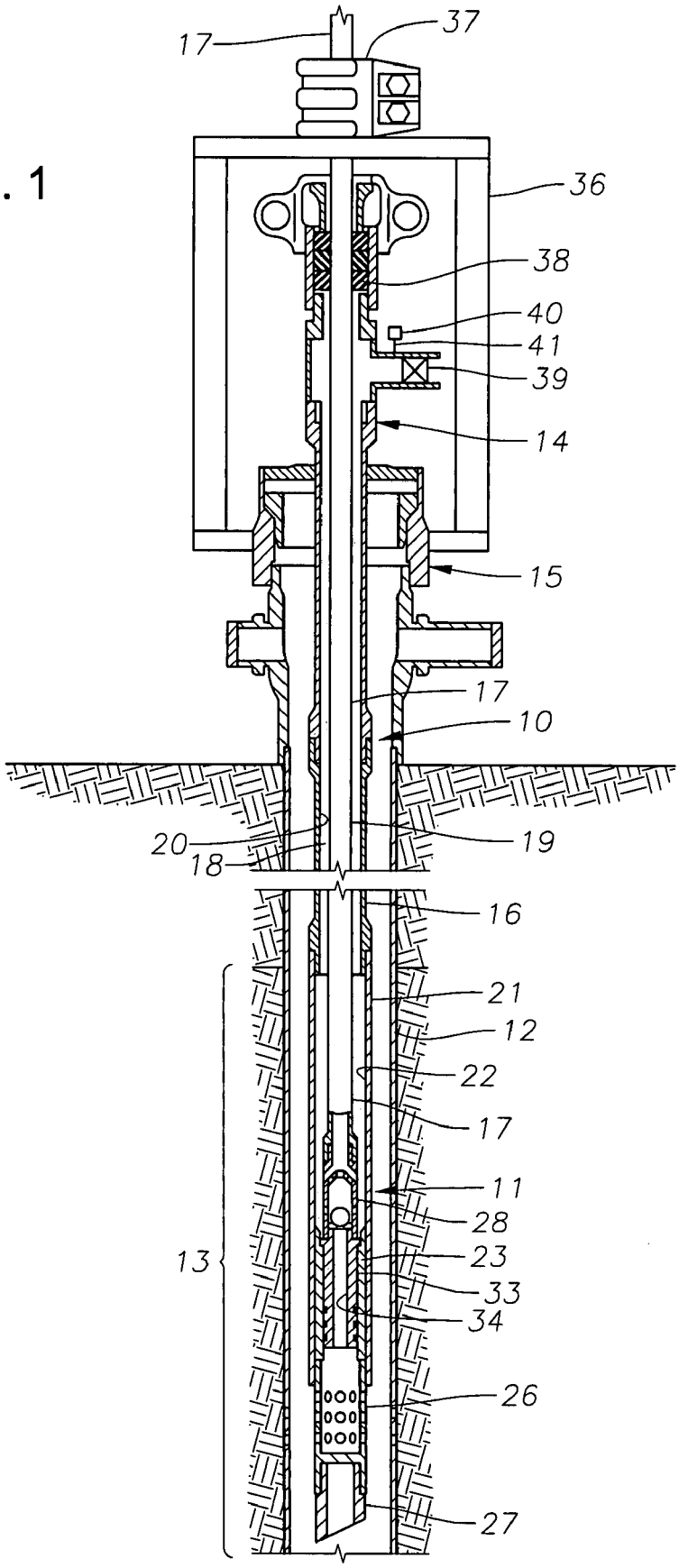

Referring now to the drawings, wherein what is shown is for the purposes of illustrating one of the various preferred embodiments for this invention and only for illustrating a preferred embodiments of the invention, and not for the purposes of limiting same, FIG. 1 shows generally one embodiment of the oil field assembly 10 for passive collection and pneumatic lifting having been installed in a oil well with the down hole part at general reference 11 positioned in the well bore casing 12 at the production zone 13 and the up hole part at general reference 14 positioned at the well head assembly at general reference 15. It should be understood by those skilled in the art that this invention has universal application to any well and other medium i.e. water and would just have to be sized and modified for the size of the well bore casing 12 and the production zone 13 area for product recovery. It should also be understood that this passive collection and pneumatic lifting system could be used with either pipe, as shown, or it could be used with endless coil tubing as well. In fact this passive collection and pneumatic lifting system could be used in any environment where passive collection and pneumatic lifting of a product other than oil for recovery would be desirable.

Referring now to FIG. 1, a more detailed embodiment of one functional element of the invention shows at least one pneumatic pipe member 16 inserted into the well bore casing 12 generally from the up hole part 14 at the well head assembly 15 to the production zone 13. This at least one pneumatic pipe member 16 is sized to receive yet another functional element of this invention the at least one fluid product pipe member 17 which is mounted within the at least one pneumatic pipe member 16 for creating an annulus 18 between the outside diameter 19 of the one fluid product pipe member 17 and the inside diameter 20 of the at least one pneumatic pipe member 16 for allowing pneumatic fluid communication there between. A jet barrel 21 is formed as part of or attached to the at least one pneumatic pipe member 16 substantially to be in and at the production zone 13. This jet barrel 21 has a inside diameter 22 which can be from at least as large as the inside diameter 20 of the at least one pneumatic pipe member 16 to at least less than the inside diameter of the well bore casing 12 and still be passed down the well bore casing 12. Those skilled in the art will appreciate that the jet barrel 21 will vary in size depending on the well bore casing 12 size and clearance to allow it to pass down the well bore casing 12 and the liquid medium to be recovered. Further those skilled in the art will appreciate that the jet barrel 21 may have to be sized to pass through a higher production zone in a well to a zone lower in the well and that the jet barrel 21 might have to be sized to pass through a well plug in the casing at the higher level to reach the desired production zone. Also those skilled in the art will appreciate the well bore casings 12 in "Stripper Wells" may not be in pristine condition and have bends and obstructions therein which will have to be adjusted for to allow its passage.

Figure 4:
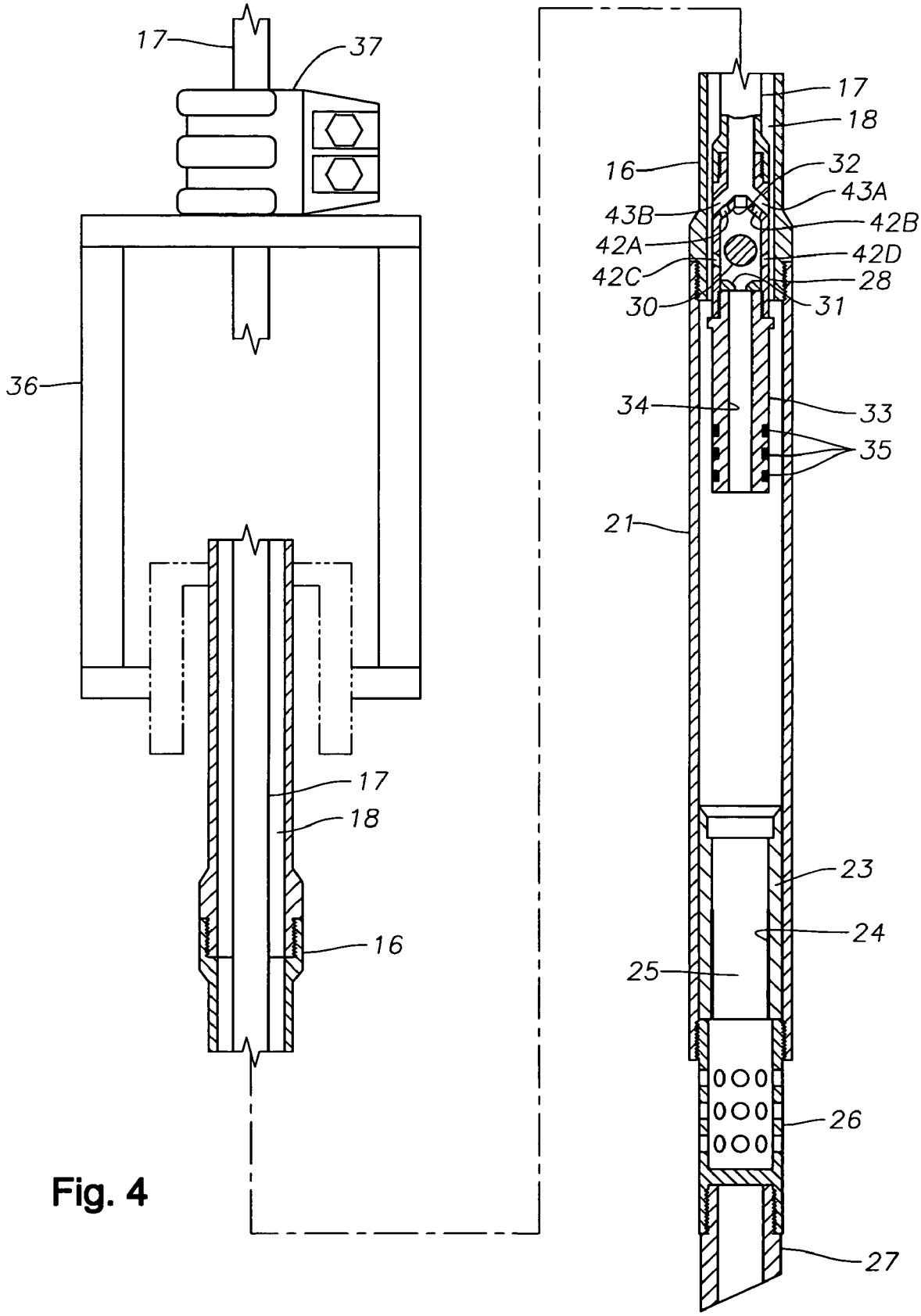
FIG. 4 is a diagrammatic and representational exploded view of one embodiment of this invention showing the at least one pneumatic pipe member and the at least one fluid pipe member and showing how they are to be fitted together and how they will fit into each other in relationship to the invention being mounted in a well.

Referring to FIG. 1 in general, but more specifically as shown in FIGS. 2 and 4 it can be seen that the one pneumatic pipe member 16 has connected to it the jet barrel 21 which is connected to a stab-in receiver 23 with sealing surfaces 24 located with in and along an open fluid communication channel 25, which is open to the well bore casing 12 below. In some embodiments there will be connected to the stab in receiver 23 a production screen 26 for allowing the product to be recovered, which in this example will be oil, to pass through while filtering out particulate matter and holding the production zone against collapse. Also in some embodiments there will be provided connected to production screen 26, a mud anchor 27 which will be landed at the bottom of the well or at a plugged off zone which establishes a landing platform which may act as the bottom of a well. The mud anchor 27, as those skilled in the art will appreciate, is to keep the production screen 26 out of debris at the bottom of the well.

Referring to FIG. 1 in general, but more specifically as shown in FIGS. 3 and 4 it can be seen that the at least one fluid product pipe member 17 which is inserted into the at least one pneumatic pipe member 16 has connected to it on its down hole end, at least in this embodiment, a one way ball valve 28 which is encased in a chamber 29 for containing the ball 30 between its down hole seating surface 31 and its up hole retaining surface 32. Also provided at the top of the valve chamber 29 are ports 43 A and 43 B located in the jet barrel 21 and in fluid communication with the at least one pneumatic pipe member 16 for driving product of recovery toward the at least one fluid product pipe member 17. Further connected to the at least one fluid product pipe member 17 at the one way ball valve 28 is a stab in member 33 with a passage way 34 there through to allow fluid communication with the zone to be produced and seal rings 35 provided along the outer surface of the stab in member 33 for the creation of a removable seal with the stab in receiving member 23 when they are fully engaged upon the full insertion of the at least one fluid product pipe member 17 in to the at least one pneumatic pipe member 16. Those skilled in the art will appreciate that the at least one fluid product pipe member 17 will have to be controlled upon its final lowering into position to not over compress the removable seal rings 35 and that the well head assembly 15 will provided tension support hangers 36 at the well head assembly 15 so as to not so over pressure the removable seal formed. The support hanger 36 as shown in this embodiment is designed to be mounted to the well head assembly 15, but out of the way of the well head assembly 15. A by product of the stab in member 33 and stab in receiver member 23 being securely connected and near the one way ball valve 28 is that the operation of the one way ball valve 28 through it activations in the chamber 29 there is a damping of any potential for hammering effects in the assembly of this invention. Also the final position of the one way ball valve 28 is such that it should come to rest substantially at the bottom of the jet barrel 21, so that upon emptying the jet barrel 21 there is no trapped product or debris to be allowed to formed around the one way ball valve 28 and its chamber 29. Also at the top of valve chamber 29 are ports 43 A and 43 B located in the jet barrel 21 in fluid communication with the at least one pneumatic pipe member 16 for driving product of recovery toward the at least one fluid product pipe member 17 To further aid in the prevention of trapped product or debris being allowed to collect, in at least some embodiments there is provided at least one port 42, but in this embodiment two ports 42 A and 42 B are provided through the chamber 29 of the one way ball valve 28. In different application of this invention the at least one port 42 shown as 42 A and 42 B may have to modified depending on the well and it down hole environment. However based on this embodiment these at least two ports 42 A and 42 B should be cut or provided at angles of from 15 degrees to 85 degrees relative to the plane of the ball 30 and the down hole seating surface 31, as shown in FIG. 7, to allow the creation of vortex flow for washing the ball 30 and down hole seating surface 31 of chamber 29 of the one way ball valve 28. In yet other applications it has been found that these at least two ports 42 C and 42 D should be cut or provided at angles of from 15 degrees to 85 degrees relative to a tangent from the surface of the valve chamber 29, as show in FIG. 6, to allow the creation of vortex flow for washing the ball 30 and down hole seating surface 31 of chamber 29 of the one way ball valve 28. In yet further applications it has been found that these two ports 42 A and 42 B; 42 C and 42 D should be cut or provided at both angles of from 15 degrees to 85 degrees relative to the plane of the ball 30 and the down hole seating surface 31 and at angles of from 15 degrees to 85 degrees relative to a tangent from the surface of the valve chamber 29 to allow and stimulate the creation of vortex flow for washing the ball 30 and the down hole seating surface 31 of chamber 29 of the one way ball valve 28. Those skilled in the art will appreciate that the washing out of the product and debris at the bottom of the jet barrel 21 and the ball 30 and it down hole seating surface 31 will help keep the assembly for passive collection and pneumatic lifting in operation over a longer period without the need for repair and cleaning as each cycle of operation has a cleaning component in it.

Also at the well head assembly 15 will be provided tension clamps 37, and hanger 36 and seat packing rings 38 to seal and hold the at least one fluid product pipe member 17 at the right tension and sealed off from the rest of the well while allowing the at least one fluid product pipe member 17 to pass through the top of the up hole well head assembly 15 and pass to a collection and separation area not shown for the separation of the product to be recovered.

Referring now also to the well head assembly 15, in FIG. 1, there is connected in fluid communication with the at least one pneumatic pipe member 16 a pneumatic valve 39 which is further connected to a pneumatic pressure generator, such as a compressor, not shown, for generating a pneumatic pressure through the pneumatic valve 39 and into the at least one pneumatic pipe member 16 which travels through the annulus 18 created between the outside diameter of the at least one fluid product pipe member 17 and the inside diameter 20 of the a least one pneumatic pipe member 16. The annulus 18 allows the pneumatic pressure generated by the compressor or other source to travel down hole to the jet barrel 21 and through ports 43 A and 43 B for operation of the passive collection and pneumatic lifting system of this invention whose operation will be further discussed.

In at least some embodiments of this invention there will be provided controllers (not shown) for regulating the pneumatic fluid pressure generated by the compressor and there will be at least one sensor 40 operationally connected through a sensor port 41 between said at least one controller, not shown, and the jet barrel 21 to determine the appropriate criteria on which to activate the controller (not shown) for generating sufficient pneumatic pressure to produce the product up hole from the production zone 13 through the at least one fluid product pipe member 17. It will be understood by those skilled in the art that the criteria sensed which controls the controller (not shown) will vary from well to well depending on the operational characteristics of a well to be recovered. Some well will be operated with criteria based on intervals of time and others operated on filling levels of the jet barrel 21 or any other criteria which may be sensed and desired for the efficient operation by the operator of a well.

To get a better understanding of the overall operation of this invention an initial installation will be described and then an operating cycle will be described to show how at least one cycle of this invention would allow recovery of product from the production zone 13 made up from a pneumatic pipe member 16 and a fluid pipe member 17. After the system of this invention is installed the product of recovery is allowed to flow through the one way ball valve 28 which drives the ball 30 off the down hole seating surface 31 to allow the collection of the product of recovery in the jet barrel 21. This passive collection of the product of recovery can occur over minutes or hours or days, but when the criteria of collection has been sensed by the sensor 40 through the sensor port 41 it activates the at least one controller (not shown) and pressure generator to generate a pneumatic fluid pressure down the annulus 18 to the jet barrel 21 filled with the product to be recovered. This pneumatic fluid pressure then drives the product of recovery through ports 43 A and 43 B toward the at least one fluid product pipe member 16 and up the at least one fluid product pipe member 16 and at the same time drives the ball 30 against down hole seating surface 32 to close off flow of the product of recovery or the pneumatic fluid pressure from entering below the one way ball valve 28 into the production zone 13. This closing off of the production zone 13 is important to prevent the higher pressure pneumatic fluid pressure from damaging the production zone 13 formation. Further as the pneumatic fluid pressure drives the product of recovery out of the jet barrel 21, the pneumatic fluid and product are driven into the one way ball valve 28, and it chamber 29 the pneumatic pressure drives the product to be recovered out of the bottom of the jet barrel 21 and through the two ports 43 A and 43 B and through ports 42 A and 42 B which in turn wash the ball 30 and the down hole seating surface 31 of debris and product of recovery. The high pneumatic fluid pressure is continued until the product to be recovered has been received up hole and then a sensor, (not shown), senses the product of recovery has been received and that only pneumatic fluid is being received, when it then shuts off the pneumatic fluid pressure and the product of recovery is separated from the pneumatic fluid by conventional means and the product of recovery is collected. Once this cycle has been run the passive collection cycle starts again as described above.

One feature which may not be readily apparent is that if this passive collection and lifting system should fail to operate it is very simple and inexpensive to repair as all that is required is the pulling of the at least one fluid production pipe member 17 with the stab in member 33 and the one way ball valve 28 off the removable seal between the stab in receiver 23 and the stab in member 33 and then returning the one way ball valve 28 to the surface at the up hole part 14. Once at the up hole part 14 the repairs to the one way ball valve 28 can be made and the at least one fluid pipe member 17, one way ball valve 28, and stab in member 33 can be returned back into the at least one pneumatic pie member 16 and lowered until reformation of the removable seals occurs between the stab in member 33 and the stab in receiver 23 for returning the passive collective and pneumatic lifting system of this invention back to full operation. Such simple and relatively inexpensive repair operation prevents the repair of a "Stripper Well" using this system from being its "Death Knell".

The invention has been described with reference to the preferred embodiments. Obviously, modifications and alterations will occur to others upon a reading and understanding of this specification but those alterations are intended to be included in this invention such that all such modifications and alterations insofar as they come with in the scope of the appended claims and equivalents there of.

Having thus described the invention, we claim:

1. A passive collection and pneumatic lifting system located in a well and partially positioned in the well bore at the product zone to be recovered and partially positioned substantially up hole from said zone to be recovered comprising;

a. at least one pneumatic pipe member, b. at least one fluid product pipe member mounted within said at least one pneumatic pipe member for creating an annulus between the outside diameter of said one fluid product pipe member and said inside diameter of said at least one pneumatic pipe member for allowing pneumatic fluid communication there between, c. a pneumatic pressure generating means for generating controlled pneumatic fluid pressure in said annulus created between said outside diameter of said at least one fluid pipe member and said inside diameter of said at least one pneumatic pipe member, d. a jet barrel having a diameter greater than said at least one fluid product pipe member and a diameter of at least less than said well bore for passage there through positioned substantially in said product zone to be recovered and connected in fluid communication between said at least one pneumatic pipe member and said at least one fluid product pipe member, e. means for delivery of said pneumatic fluid pressure from said at least one pneumatic pipe member to said jet barrel and in a direction for driving said recovery product toward said at least one fluid product pipe member, f. a one way valve means for allowing said product for recovery to flow into said jet barrel, but preventing pneumatic fluid pressure from entering said zone of product recovery in said well formed from a ball, a seat for said ball and a chamber connected to said at least one fluid product pipe member and said chamber having at least one production port for driving said product of recovery toward said at least one fluid product pipe and at least one port through said chamber for creating a vortex in said chamber for agitating and cleaning said ball and seat of well debris on each cycle of pneumatic fluid pressure generation in said lifting system and located substantially at the bottom of said jet barrel and in fluid communication with said product zone to be recovered and in communication with said jet barrel for the introduction of pneumatic fluid pressure sufficient to drive said product collected in said jet barrel up hole through said at least one fluid product pipe member for recovery of said product, g. a seal means formed from a stab-in member having at least one seal member thereon connected to said one-way valve means, and stab-in receiving member operationally connected to said at least one pneumatic pipe member for forming a removable seal upon receiving said stab-in member located below said valve means for sealing said product zone to be recovered from flow except through said one-way valve means and for preventing hammering effects in said jet barrel on said one-way valve means closing communication of said valve means and product zones, and h. a well suspension member connected up hole for holding said at least one fluid product pipe member, one-way valve means, and stab-in tension and allowing sufficient pressure to be exerted for forming a removable seal between said stab-in having said at least one seal and said stab-in receiver member.

2. A passive collection and pneumatic lifting system located in a well as in claim 1 wherein said at least one port in said valve chamber is formed at 15 degrees to 85 degrees through said chamber relative to said seat for said ball for enhanced vortex flow of said pneumatic fluid pressure against said seat and ball in said chamber.

3. A passive collection and pneumatic lifting system located in a well as in claim 1 wherein said at least one port in said valve chamber is formed at 15 degrees to 85 degrees through said chamber relative to a tangent from the surface of said valve chamber for enhanced vortex flow of said pneumatic fluid pressure against said seat and ball in said chamber.

4. A passive collection and pneumatic lifting system located in a well as in claim 1 wherein said at least one port in said valve chamber is formed at both 15 degrees to 85 degrees through said valve chamber relative to said valve seat and at 5 degrees to 85 degrees through said chamber relative to a tangent from the surface of said valve chamber for enhanced vortex flow of said pneumatic fluid pressure against seat and ball in said chamber.

5. A passive collection and pneumatic lifting system located in a well as in claim 4 further comprising;

a. at least one controller for regulating said pneumatic fluid pressure generated by said generating means for controlled pneumatic pressure, and b. at least one sensor operationally connected between sad at least one controller and said jet barrel to determine the appropriate criteria on which to activate said at least one controller for regulating said pneumatic fluid pressure for generating sufficient pneumatic fluid pressure to produce said product of recovery up hole form said well product zone.

6. A passive collection and pneumatic lifting system located in a well as in claim 5 wherein said at least one sensor operationally connected between said at least one controller and said jet barrel to determine the appropriate criteria on which to activate said at least one controller is a sensor which determines the desired level of product in said jet barrel for when lifting said product of recovery up hole from said well product zone should occur.

7. A passive collection and pneumatic lifting system located in a well as in claim 5 wherein said at least one sensor operationally connected between said at least one controller and said jet barrel to determine the appropriate criteria on which to activate said at least one controller is a time sensor which determines intervals of time between filling of product in said jet barrel for when lifting said product of recovery up hole from said well product zone should occur and the duration of the pneumatic fluid pressure to produce said product up hole.

8. A passive collection and pneumatic lifting system located in a well as in claim 6 further comprising;

a. at least a second sensor means located substantially up hole for determining and sensing said product of recovery from said pneumatic fluid and for activating separation of said pneumatic fluid, from said product of recovery lifted.

* * * * *